US008189815B2

(12) United States Patent
Chen

(10) Patent No.: US 8,189,815 B2
(45) Date of Patent: May 29, 2012

(54) MICROPHONE CIRCUIT

(75) Inventor: Yang-Yu Chen, Taipei County (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 805 days.

(21) Appl. No.: 12/347,181

(22) Filed: Dec. 31, 2008

(65) Prior Publication Data

US 2010/0054494 A1 Mar. 4, 2010

(30) Foreign Application Priority Data

Aug. 28, 2008 (CN) ..... 2008 1 0304275

(51) Int. Cl.
*H04R 3/00* (2006.01)

(52) U.S. Cl. ..... 381/113; 381/111; 381/112; 381/91; 330/253; 330/255

(58) Field of Classification Search ..... 381/91–92, 381/111–113, 115, 122, 114, 26, 4; 330/253, 330/255, 258, 263
See application file for complete search history.

(56) References Cited

U.S. PATENT DOCUMENTS

| | | | | |
|---|---|---|---|---|
| 6,516,069 | B1 * | 2/2003 | Takeuchi et al. | 381/122 |
| 6,664,851 | B1 * | 12/2003 | Pihlstrom et al. | 330/51 |
| 6,882,734 | B2 * | 4/2005 | Watson et al. | 381/92 |
| 7,449,950 | B2 * | 11/2008 | Ivanov | 330/253 |
| 2001/0034217 | A1 * | 10/2001 | Loke et al. | 455/126 |
| 2005/0207596 | A1 * | 9/2005 | Beretta et al. | 381/111 |
| 2007/0018318 | A1 * | 1/2007 | Marsh et al. | 257/737 |
| 2008/0100435 | A1 * | 5/2008 | Jorgenson et al. | 340/539.22 |

OTHER PUBLICATIONS

Maxim, Differential Microphone Preamplifier with Internal Bias and Complete Shutdown, MAX4063, 2003.*

* cited by examiner

*Primary Examiner* — Davetta W Goins
*Assistant Examiner* — Kuassi Ganmavo
(74) *Attorney, Agent, or Firm* — Altis Law Group, Inc.

(57) ABSTRACT

A microphone circuit includes a signal generating module, a filtering module, a transmitting module and a switch module. The signal generating module transforms audio signals into electronic signals. The filtering module is connected to the signal generating module to filter the electronic signals sent from the signal generating module. The transmitting module is connected to the filtering module to transmit the signals sent from the filtering module. The switch module is connected to the signal generating module to selectively regulate the microphone circuit to function as a differential microphone circuit or a single-ended microphone circuit.

10 Claims, 5 Drawing Sheets

MICROPHONE CIRCUIT

BACKGROUND

1. Field of the Invention

The present invention relates to a microphone circuit, and particularly to a multifunctional microphone circuit.

2. Description of Related Art

Generally, microphone circuits can be classified into differential microphone circuits and single-ended microphone circuits. A differential microphone circuit outputs both a forward signal and a reverse signal to transmit information together resulting in a relatively higher acoustic quality. A signal-ended microphone circuit outputs only a forward signal to transmit information resulting in using relatively less electric power than the differential microphone circuit.

A portable electronic device, such as a mobile phone or a personal digital assistant (PDA), often employs both a differential microphone circuit and a single-ended microphone circuit. In manufacture, the two microphone circuits are usually fabricated as chips and installed in the portable electronic device. In use, the two microphone circuits can be selected. However, the process of respectively fabricating the two microphone circuits as chips and installing them in the portable electronic device may be expensive and time-consuming. Furthermore, a volume and weight of the portable electronic device may be increased.

Therefore, there is room for improvement within the art.

BRIEF DESCRIPTION OF THE DRAWINGS

Many aspects of the present microphone circuit can be better understood with reference to the following drawings. The components in the various drawings are not necessarily drawn to scale, the emphasis instead being placed upon clearly illustrating the principles of the present microphone circuit. Moreover, in the drawings, like reference numerals designate corresponding parts throughout the figures.

DETAILED DESCRIPTION

Figure 1:
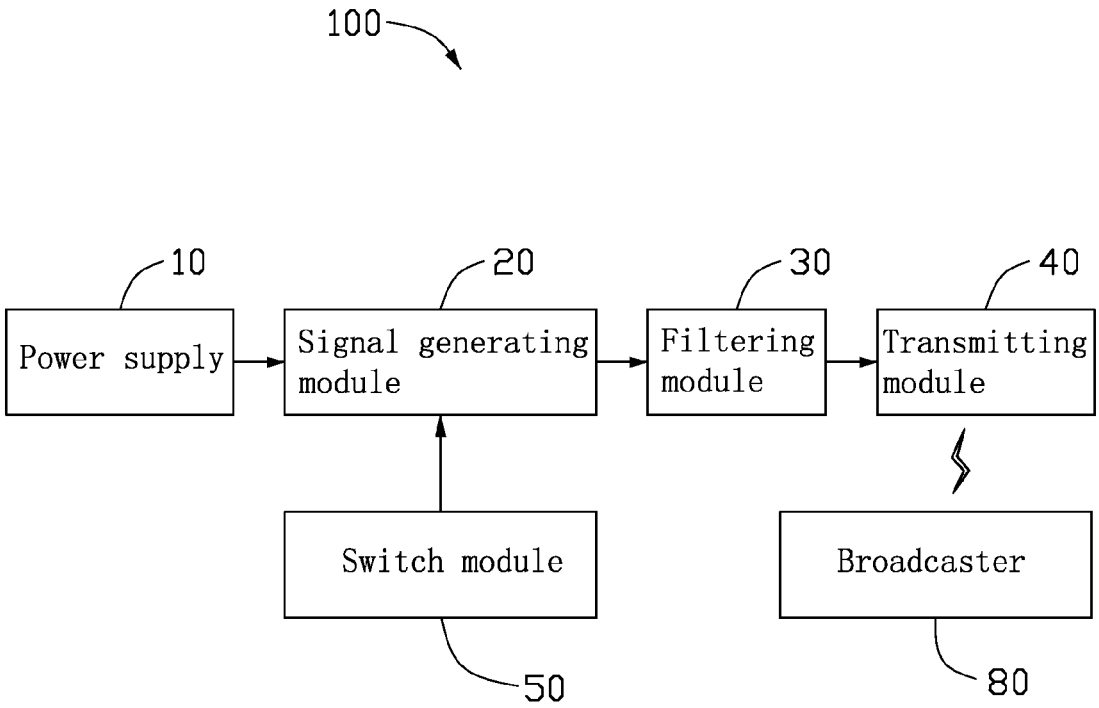
FIG. 1 is a diagram of a microphone circuit, according to an exemplary embodiment.

Referring to FIG. 1, a microphone circuit 100 according to an exemplary embodiment is provided. The microphone circuit 100 is fabricated as a single chip installed in a portable electronic device (not shown), such as a mobile phone, a laptop, or a personal digital assistant (PDA) to receive and transmit audio signals. The microphone circuit 100 is capable of transmitting differential signals or single-ended signals, and can be selected to work as a differential microphone circuit or a single-ended microphone circuit. In one embodiment, the microphone circuit 100 includes a power supply 10, a signal generating module 20 connected to the power supply 10, a filtering module 30 connected to the signal generating module 20, a transmitting module 40 connected to the filtering module 30 and a switch module 50 connected to the signal generating module 20.

Depending on the embodiment, the power supply 10 can be a typical battery of the portable electronic device or an independent battery configured for supplying power to the microphone circuit 100.

Figure 2:
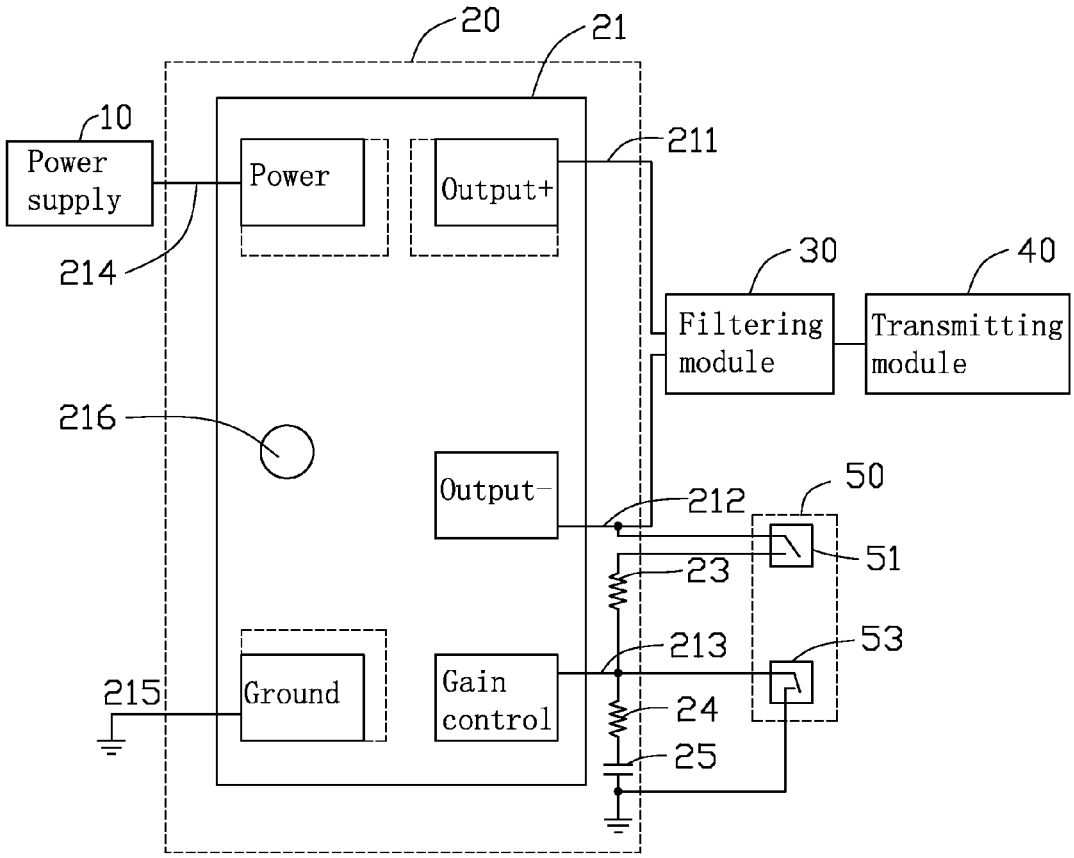
FIG. 2 is a diagram of the microphone circuit shown in FIG. 1 working as a differential microphone circuit.
Figure 3:
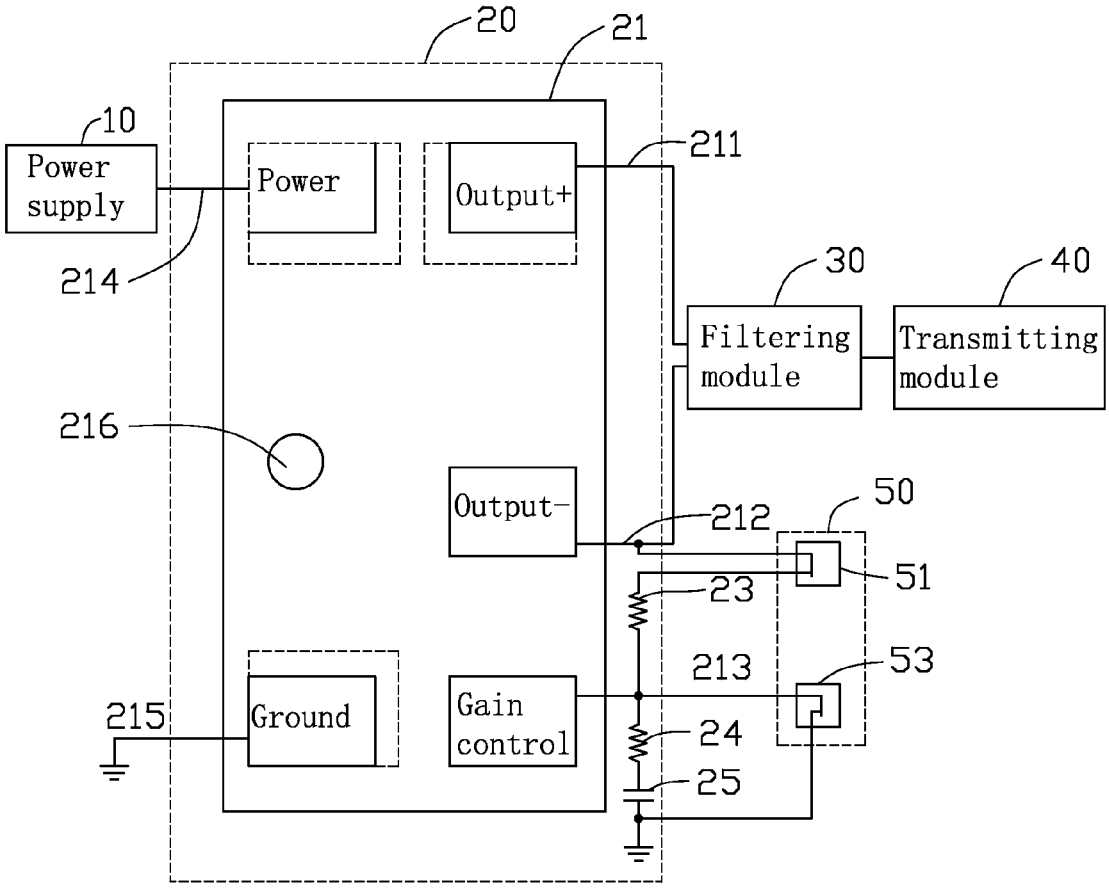
FIG. 3 is a diagram of the microphone circuit shown in FIG. 1 working as a single-ended microphone circuit.

Also referring to FIG. 2 and FIG. 3, the signal generating module 20 includes a signal generator 21, a first resistor 23, a second resistor 24 and a capacitor 25. The signal generator 21 is capable of transforming received audio signals into electronic signals for transmission. As a differential microphone circuit, the signal generator 21 of the microphone circuit 100 transforms a received audio signal into a difference between a forward electronic signal and a reverse electronic signal. As a single-ended microphone circuit, the signal generator 21 transforms the received audio signal into only a forward electronic signal. The signal generator 21 has a first connector 211 configured to transmit forward electronic signals, a second connector 212 configured to transmit reverse electronic signals, a third connector 213 configured for grounding or functioning as a gain control connector, a fourth connector 214 connected to the power supply 10, a fifth connector 215 configured for grounding, and a sound receiving hole 216 defined therein to receive audio signals. The resistance of the first resistor 23 is about 0 ohms. The first resistor 23, the second resistor 24 and the capacitor 25 are connected in series.

The filtering module 30 may be a typical filter connected to the first connector 211 and the second connector 212 to filter the forward electronic signals and reverse electronic signals sent from the signal generating module 20. The filtering module 30 may filter noise or high/low frequencies, for example. The transmitting module 40 can be a data cable or an antenna configured for transmitting the filtered electronic signals to a broadcaster 80, such as a reproducer connected to the portable electronic device or other portable electronic devices communicating with the portable electronic device, thus the electronic signals are transformed into audio signals to be played.

The switch module 50 includes a first switch 51 and a second switch 53. The first switch 51 is connected between the second connector 212 and the first resistor 23, such that the first resistor 23 and the second resistor 24 are connected in series between the first switch 51 and the capacitor 25. The capacitor 25 has one pole connected to the second resistor 24 and another pole grounded. The second switch 53 has one end connected between the first resistor 23 and the second resistor 24 and another end grounded. The third connector 213 is connected between the first resistor 23 and the second resistor 24. Thus, the second switch 53 is connected between the third connector 213 and ground.

Referring to FIG. 2, as a differential microphone circuit, the first switch 51 and the second switch 53 are switched off. The fourth connector 214 receives power from the power supply 10, and the fifth connector 215 connects the microphone circuit 100 to ground. An audio signal can be received by the sound receiving hole 216, and then is transformed into an electronic signal. The first connector 211 outputs a forward electronic signal and the second connector 212 outputs a reverse electronic signal, thereby transmitting the electronic signals as a difference between the forward electronic signal and the reverse electronic signal, i.e., as a differential electronic signal. The third connector 213, the second resistor 24 and the capacitor 25 are connected in series to form a gain control circuit configured to regulate a gain of the microphone circuit 100 functioning as a differential microphone circuit. The differential electronic signal formed by the forward electronic signal and the reverse electronic signal is then filtered by the filtering module 30 and transmitted by the transmitting module 40.

Referring to FIG. 3, as a single-ended microphone circuit, the first switch 51 and the second switch 53 are switched on. In use, the power supply 10, the filtering module 30, the transmitting module 40, the first connector 211, the fourth connector 214, the fifth connector 215, and the sound receiving hole 216 function similarly to that of the above-mentioned differential microphone circuit. However, the second connector 212 is grounded via the first switch 51, the first resistor 23, and the second switch 53 connected in series. Additionally, the third connector is grounded via the second switch 53. Therefore, only the first connector 211 can send signals to the filtering module 30, thus the microphone circuit 100 functions as a single-ended microphone circuit.

Figure 4:
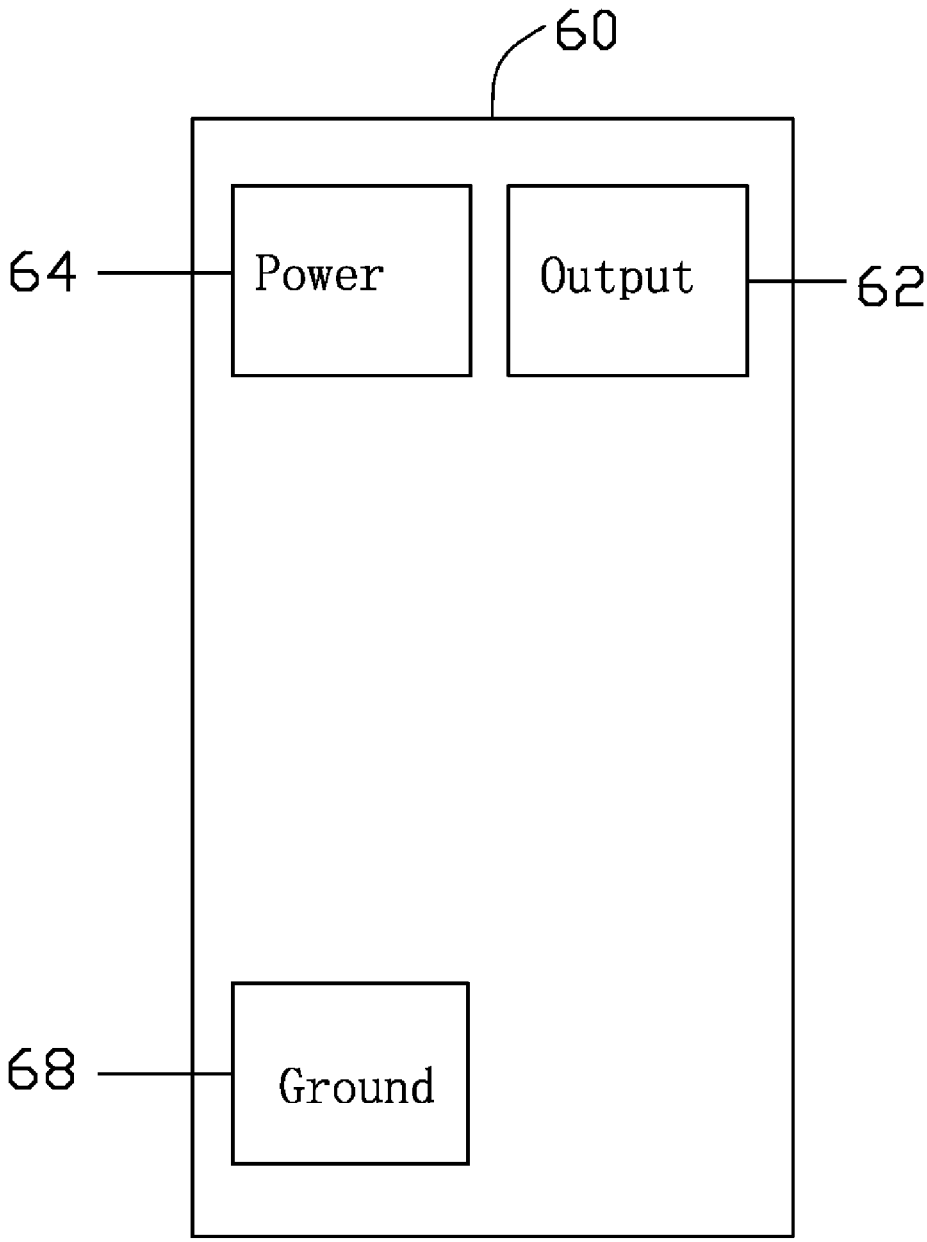
FIG. 4 is a diagram of a single-ended microphone circuit configured to form the microphone circuit shown in FIG. 1.
Figure 5:
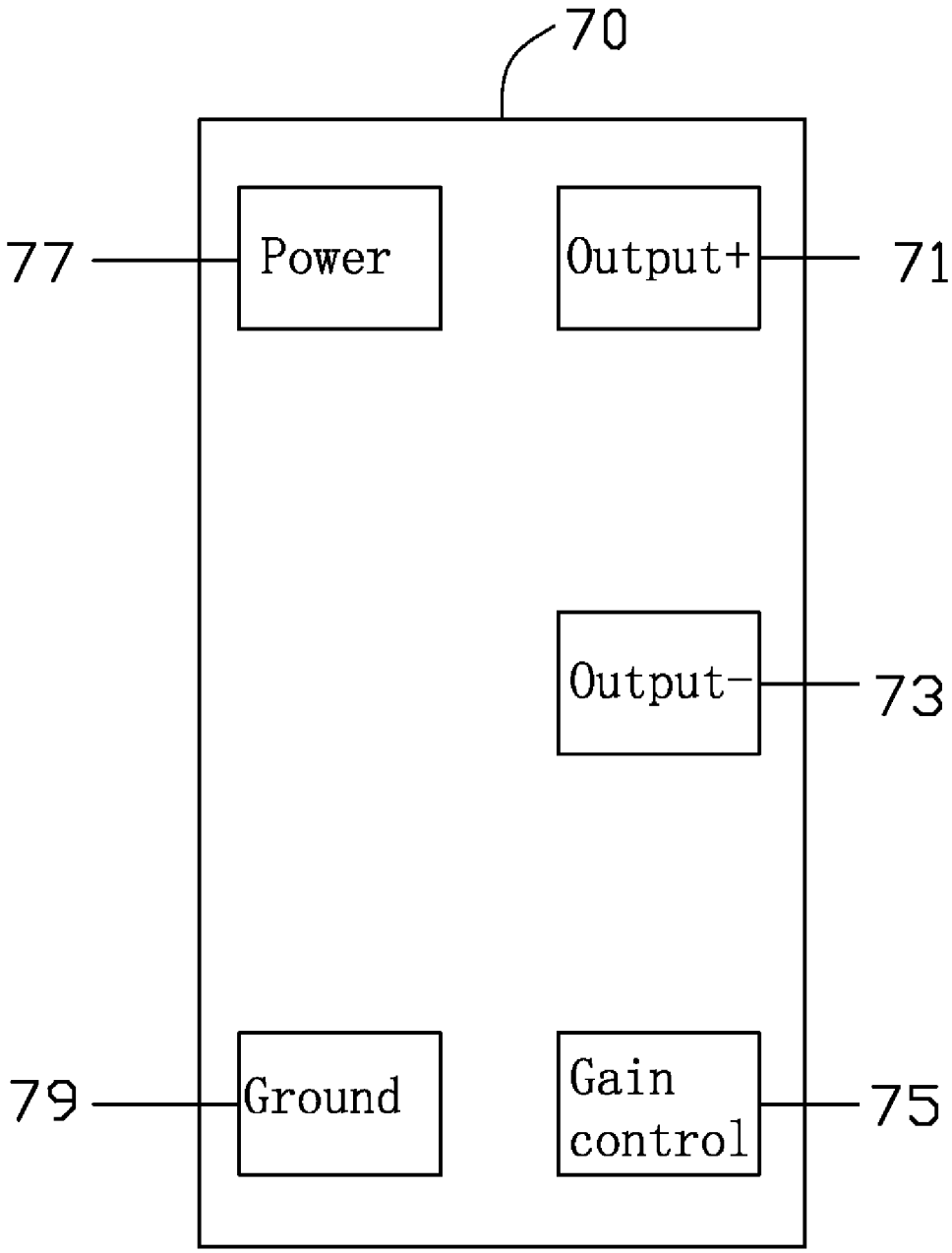
FIG. 5 is a diagram of a differential microphone circuit configured to form the microphone circuit shown in FIG. 1.

FIG. 4 and FIG. 5 show one embodiment of the microphone circuit 100 implemented as a chip to be installed into a portable electronic device. The microphone circuit 100 can be formed by a single-ended microphone circuit 60 and a differential microphone circuit 70 integrated together. As shown in FIG. 4 and FIG. 5, the single-ended microphone circuit 60 includes a signal output connector 62, a power connector 64 and a ground connector 68. The differential microphone circuit 70 includes a forward signal output connector 71, a reverse signal output connector 73, a gain control connector 75, a power connector 77 and a ground connector 79. In one embodiment, the single-ended microphone circuit 60 and the differential microphone circuit 70 may comprise corresponding circuitry for a forward, and a reverse and forward signal.

The single-ended microphone circuit 60 and the differential microphone circuit 70 are integrated together on a same chip using surface mounted technology (SMT). Particularly, the signal output connector 62 and the forward signal output connector 71 are integrated together to form the first connector 211. The reverse signal output connector 73 forms the second connector 212. The gain control connector 75 forms the third connector 213. The power connector 64 and the power connector 77 are integrated together to form the fourth connector 214. The ground connector 68 and the ground connector 79 are integrated together to form the fifth connector 215. Thus, the microphone circuit 100 is formed by integration of the single-ended microphone circuit 60 and the differential microphone circuit 70.

The present microphone circuit 100 is fabricated as a single multifunctional chip and has a more simple structure. Thus, the microphone circuit 100 may be produced less expensively and be installed into the portable electronic device more conveniently. A volume and weight of a portable electronic device employing the microphone circuit 100 can also be decreased because of the single chip nature of the microphone circuit.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A microphone circuit, comprising:

a signal generating module transforming audio signals into electronic signals, the signal generating module including a first resistor, a second resistor, a capacitor, and a signal generator, the first resistor, the second resistor, and the capacitor connected in series, the signal generator having a first connector configured for transmitting a forward electronic signal, a second connector configured for transmitting a reverse electronic signal, and a third connector grounded or functioning as a gain control connector;

a filtering module connected to the signal generating module to filter the electronic signals;

a transmitting module connected to the filtering module to transmit the filtered electronic signals to a broadcaster; and a switch module connected to the signal generating module to allow both the forward electronic signal and the reverse electronic signal to be sent to the filtering module or only the forward electronic signal to be sent to the filtering module to selectively regulate the microphone circuit to function as a differential microphone circuit or a single-ended microphone circuit; the switch module including a first switch connected between the second connector and the first resistor, such that the first resistor and the second resistor are connected in series between the first switch and the capacitor.

2. The microphone circuit as claimed in claim 1, wherein the microphone circuit is fabricated as a single chip.

3. The microphone circuit as claimed in claim 1, further comprising a power supply connected to the signal generating module to supply power to the microphone circuit.

4. The microphone circuit as claimed in claim 1, wherein the resistance of the first resistor is about 0 ohms.

5. The microphone circuit as claimed in claim 1, wherein the capacitor has one pole connected to the second resistor and another pole grounded, and the third connector is connected between the first resistor and the second resistor.

6. The microphone circuit as claimed in claim 1, wherein the switch module further includes a second switch having one end connected between the first resistor and the second resistor and another end grounded.

7. The microphone circuit as claimed in claim 1, wherein the signal generator further includes a fourth connector connected to the power supply and a fifth connector grounded.

8. The microphone circuit as claimed in claim 1, wherein the signal generator further includes a sound receiving hole defined therein to receive the audio signals.

9. The microphone circuit as claimed in claim 1, wherein the microphone circuit is formed by a single-ended microphone circuit and a differential microphone circuit integrated together.

10. The microphone circuit as claimed in claim 9, wherein the single-ended microphone circuit and the differential microphone circuit are integrated on a same chip using surface mounted technology (SMT).

* * * * *